US008695313B2

(12) United States Patent
Gaug et al.

(10) Patent No.: US 8,695,313 B2
(45) Date of Patent: Apr. 15, 2014

(54) METHOD OF INSERTING MAIL PIECES INTO INDIVIDUAL FOLDER

(75) Inventors: Mark Gaug, Vestal, NY (US); Bryan Dalton, Endicott, NY (US); John Nasakaitis, Elmira, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 672 days.

(21) Appl. No.: 12/631,306

(22) Filed: Dec. 4, 2009

(65) Prior Publication Data

US 2010/0139221 A1 Jun. 10, 2010

Related U.S. Application Data

(60) Provisional application No. 61/119,758, filed on Dec. 4, 2008.

(51) Int. Cl.
*B65B 1/04* (2006.01)

(52) U.S. Cl.
USPC ..... 53/473; 53/469; 53/246; 53/284.3; 53/173

(58) Field of Classification Search
USPC ..... 53/469, 473, 246, 284.3, 173, 569; 209/900, 908–910
See application file for complete search history.

(56) References Cited

U.S. PATENT DOCUMENTS

| | | | | |
|---|---|---|---|---|
| 3,573,748 | A * | 4/1971 | Holme | 209/584 |
| 5,220,770 | A * | 6/1993 | Szewczyk et al. | 53/493 |
| 5,823,320 | A * | 10/1998 | Seidel et al. | 198/803.5 |
| 6,341,700 | B1 * | 1/2002 | Soderstrom | 209/703 |
| 6,913,151 | B2 * | 7/2005 | Stevenson | 209/630 |
| 6,950,724 | B2 * | 9/2005 | Mileaf et al. | 700/224 |
| 7,000,364 | B2 * | 2/2006 | Middelberg et al. | 53/381.7 |
| 7,389,884 | B2 * | 6/2008 | Stravitz | 211/11 |
| 7,464,822 | B2 * | 12/2008 | Coffelt et al. | 209/559 |
| 7,547,174 | B1 * | 6/2009 | Pippin et al. | 414/280 |
| 7,556,250 | B2 * | 7/2009 | Beck | 270/58.06 |
| 7,644,004 | B2 * | 1/2010 | Guyett et al. | 705/1.1 |
| 7,728,244 | B2 * | 6/2010 | De Leo et al. | 209/583 |
| 7,905,344 | B2 * | 3/2011 | Fritsche et al. | 198/704 |
| 8,191,883 | B2 * | 6/2012 | Bader et al. | 270/52.14 |
| 8,230,141 | B2 * | 7/2012 | Zimmermann | 710/53 |
| 2002/0079255 | A1 * | 6/2002 | Anderson | 209/703 |
| 2003/0038065 | A1 * | 2/2003 | Pippin et al. | 209/584 |
| 2003/0121236 | A1 * | 7/2003 | Middelberg et al. | 53/460 |
| 2003/0168388 | A1 | 9/2003 | Malatesta | |
| 2004/0172923 | A1 * | 9/2004 | Rawlinson | 53/460 |
| 2005/0067331 | A1 * | 3/2005 | De Leo et al. | 209/584 |
| 2005/0205449 | A1 * | 9/2005 | Frankeny | 206/425 |

(Continued)

OTHER PUBLICATIONS

International Search Report for International Application No. PCT/US08/10715.

*Primary Examiner* — Hemant M Desai
(74) *Attorney, Agent, or Firm* — Marcus P. Efthimou; Andrew M. Calderon; Roberts Mlotkowski Safran & Cole, P.C.

(57) ABSTRACT

A mail piece insertion mechanism is provided and, more particularly, mail piece insertion mechanisms and methods used for inserting mail pieces such as, for example, residual mail, into individual mail piece folders or containers is provided. The method of inserting mail pieces into folders includes opening the folders and aligning a mechanism with the opened folders and inserting the mail pieces therein. The insertion mechanism includes a mechanism configured open folders and a mechanism configured to insert mail pieces into the open folders.

11 Claims, 8 Drawing Sheets

(56) References Cited

U.S. PATENT DOCUMENTS

| | | | | |
|---|---|---|---|---|
| 2005/0247606 | A1 | 11/2005 | Redford et al. | |
| 2006/0144763 | A1* | 7/2006 | Coffelt et al. | 209/584 |
| 2006/0249437 | A1* | 11/2006 | Anderson | 209/703 |
| 2006/0259185 | A1* | 11/2006 | Berdelle-Hilge | 700/223 |
| 2007/0056886 | A1 | 3/2007 | Yui | |
| 2007/0164496 | A1* | 7/2007 | Kapturowski et al. | 270/52.01 |
| 2007/0209976 | A1* | 9/2007 | Worth et al. | 209/584 |
| 2008/0197174 | A1* | 8/2008 | Wittmeyer et al. | 229/67.1 |
| 2008/0230449 | A1* | 9/2008 | Stemmle | 209/584 |
| 2009/0060698 | A1* | 3/2009 | Enenkel | 414/592 |
| 2009/0158693 | A1* | 6/2009 | Rosenkranz | 53/468 |
| 2009/0236251 | A1* | 9/2009 | Berdelle-Hilge et al. | 206/425 |

* cited by examiner

METHOD OF INSERTING MAIL PIECES INTO INDIVIDUAL FOLDER

CROSS REFERENCE TO RELATED APPLICATION

The present invention claims priority to Provisional Application Ser. No. 61/119,758, filed on Dec. 4, 2008, the contents of which are incorporated by reference in their entirety.

INCORPORATION BY REFERENCE

This application incorporates by reference in its entirely the contents of copending application serial no. PCT US/2008/10715, filed on Sep. 12, 2008.

FIELD OF THE INVENTION

The invention generally relates to mail piece insertion mechanisms and, more particularly, to mail piece insertion mechanisms and methods used for inserting mail pieces such as, for example, residual mail, into individual mail piece folders or containers.

BACKGROUND DESCRIPTION

The sorting of mail is a very complex, time-consuming task. In general, the sorting of mail is processed through many stages, including front end and back end processes. For example, these processes include reading delivery information, and sorting and/or sequencing the mail in delivery order sequence. These processes can either be manual or automated, depending on the mail sorting facility, the type of mail being sorted such as packages, flats, letters and the like. A host of other factors may also contribute to the automation of the mail sorting, from budgetary concerns to modernization initiatives to access to appropriate technologies to a host of other factors.

Also, the delivery of mail is known to be critical to commerce and the underlying economy. It is thus critical to commerce and the underlying economy to provide efficient delivery of such mail in both a cost effective and time efficient manner. This includes, for example, reading delivery destination information from the mail, and arranging the randomly deposited mail into a sequential delivery order for delivery to a destination point based on the destination information.

In current sorting processes, mail pieces are automatically sorted using sorting and/or sequencing machines. In one type of sorting and/or sequencing machine, a series of pinch belts, in combination with logic and optical character recognition (OCR) systems used to capture destination information is used to automatically sort and/or sequence the mail pieces. These types of sorting and/or sequencing machines are designed for a single type of mail piece with a certain form factor. For example, these machines may be limited to sorting only envelopes, while another machine may be designed specifically for only flat type mail pieces.

Advantageously, a new generation of machines is currently being designed and implemented that can automatically sort mail pieces of many different form factors on the same type of machine. These machines use folders (containers) which are designed to hold many different types and sizes of mail pieces. To the benefit of sorting facilities, only a single type of machine is now required to sort and/or sequence a host of different mail pieces, from postcards, to envelopes, to flats, etc. This type of system is disclosed in application serial no. PCT US/2008/10715, filed on Sep. 12, 2008, the contents of which are incorporated by reference in its entirely.

Residual mail pieces (as well as large or non-standard sized mail pieces), in many instances, are sorted manually, which considerably increases the time required to sequence all of the mail pieces into a delivery point sequence. Residual mail pieces may be those mail pieces that could not be automatically sorted due to, for example, size (e.g., too thick or too thin), damage (e.g., crumpled, taped, etc. mail pieces) or other reasons that might cause a jam the pinch belts in the sorting and/or sequencing machines.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF INVENTION

The invention is directed to, for example, mail piece insertion mechanisms and, more particularly, to mail piece insertion mechanisms and methods used for inserting mail such as, for example, residual mail, into individual mail piece folders or containers. The mail piece insertion mechanisms may be used to insert residual mail and other types of mail pieces into a folder for eventual sorting and/or sequencing processes. The mail piece insertion mechanisms are, in one embodiment, modular systems adapted to be fitted to any number or type of sorting and/or sequencing systems such as the mail and/or flat sorting and sequencing systems manufactured by Lockheed Martin Corporation. The mail piece insertion mechanisms are also well adapted to be retrofitted into the facility wide sorting and/or sequencing system described and shown in copending application serial no. PCT US/2008/10715, filed on Sep. 12, 2008. The mail piece insertion mechanisms of the present invention can be used in a host of other applications such as warehousing and storage applications all contemplated for use with the invention.

Advantageously, in aspects of the invention and as discussed in more detail below, the mail piece insertion mechanisms are designed to ensure proper insertion of mail pieces, of many different form factors and conditions, into folders with or without any manual intervention. The mail piece insertion mechanisms thus reduce labor and processing costs, as well as increase efficiency of any associated system. For example, the processes and mechanisms described herein considerably reduce manual steps and make the remaining manual steps easier for the operators.

Mail Piece Insertion Mechanisms

Figure 1:
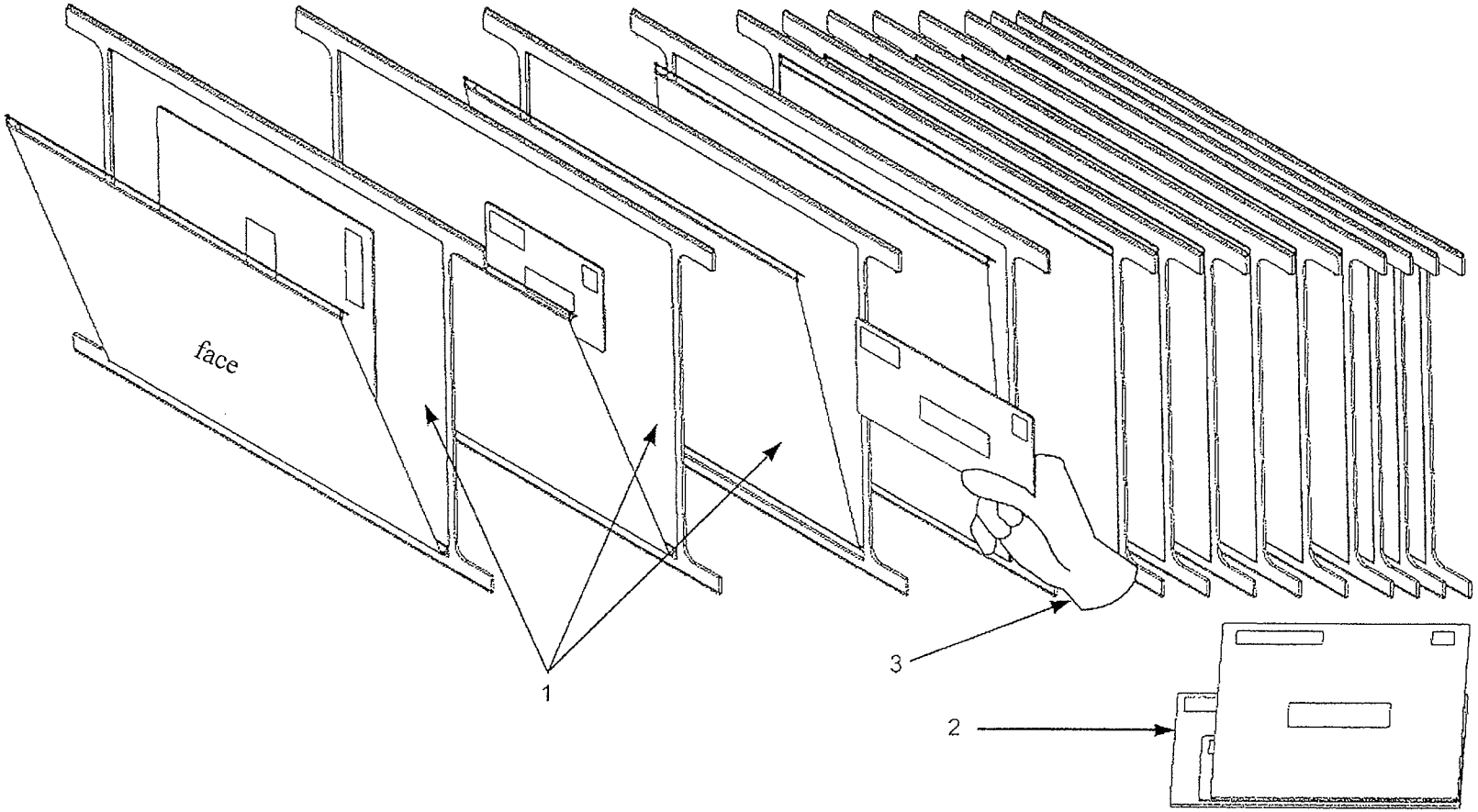
FIG. 1 shows open folders and a method of inserting mail pieces therein in accordance aspects of the invention.

FIG. 1 shows open and closed folders and a method of inserting mail pieces into the open folders in accordance with aspects of the invention. As shown in FIG. 1, mail pieces 3 (e.g., residual mail pieces) are manually placed into opened folders 1. The folders 1 can be any type of folder such as those described in, for example, copending application serial no. PCT US/2008/10715, filed on Sep. 12, 2008. Prior to insertion, the mail pieces run through a series of processes and machines including a camera, bar code reader, scale, photo eyes, and a labeler. These devices characterize and tag the mail pieces (a unique identifier on the mail piece) so that the system can detect the size, shape, condition, and final destination of the mail piece 3 as is known to those of skill in the art. As such, further explanation is not required herein for one of skill in the art to understand the invention. At the output of these instruments, the mail pieces are provided in a stack 2. The operator 3 can take these mail pieces 3 from the stack 2 and insert them into the open folders 1.

In embodiments, the folders 1 open and close automatically at a station where the operator performs the insertion. As an illustrative example, the folders 1 can include a flexible appendage or tab extending from a face of the folder. As the folder comes into an insertion station, the appendage or tab contacts a stationary object (e.g., stationary bar, wall, side rail or protrusion) and, as the folder 1 continues to pass through the insertion station, the contact or friction between the appendage or tab and the stationary object will cause the folder 1 to automatically open, as shown, for example, at the left side of FIG. 1. As the folder 1 continues through the insertion area, the operator can easily insert the mail pieces 3 into the folder 1. As the mail pieces are placed in a stack 2, the operator need only remove the mail piece from the top of the stack for insertion. At this time or soon thereafter, the inserted mail piece is identified with the particular folder by, for example, using OCR and logic of the system, for future sorting and/or sequencing processes. It should also be understood that the flexible nature of the appendage or tab will allow the folder 1 to pass the stationary object and result in the folder 1 automatically closing, now with the mail piece 3 inserted therein.

In additional embodiments, the folders can be collapsible folders formed as a parallelogram with each outer wall hinged to an adjacent wall. As the folders pass through the insertion station, a bottom of the folder will contact a floor or other stationary object resulting in the folder being pushed slightly upward. As the folder is pushed slightly upward, the folder will automatically expand into a box, with a side of the box having an opening, e.g., a side facing the operator. The operator can then insert the mail piece 3 into this opening. As the folder is transported past the floor or other stationary object, the folder will automatically collapse to substantially its original configuration (except the mail piece being inserted therein) since the bottom portion of the folder will no longer make any contact with the floor or other stationary object.

In still another embodiment, the folder can be a rigid type folder, always in the open position. In this embodiment, although additional space is required to accommodate such folders, the folders will always be in the open position and, as such, the operator can place the mail pieces therein at the insertion station. It is also noted that although several different folders were discussed above, other types of folders are also contemplated by the present invention.

Figure 2:
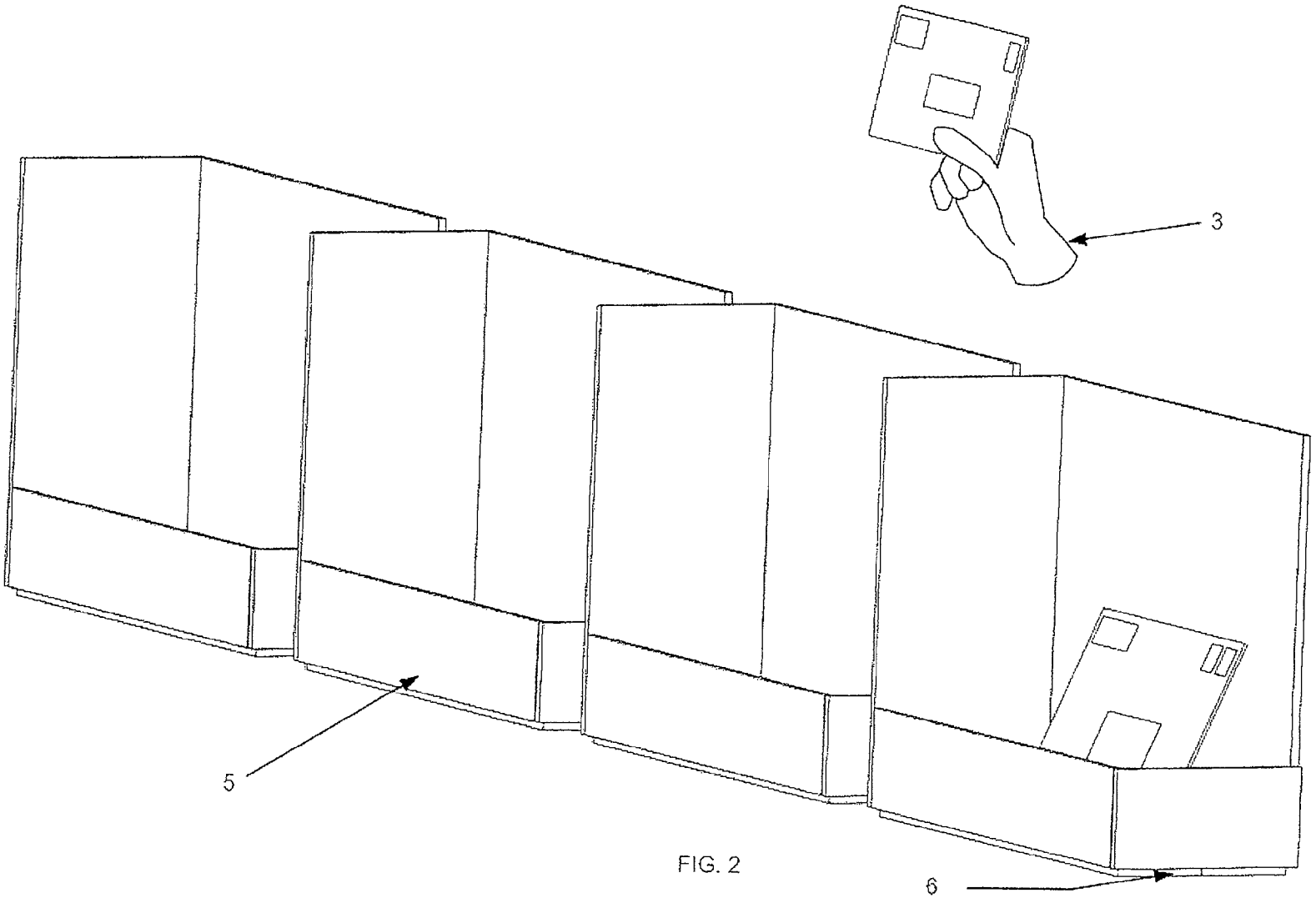
FIG. 2 is a perspective view of containers used to insert mail pieces into folders in accordance with aspects of the invention.
Figure 3A:
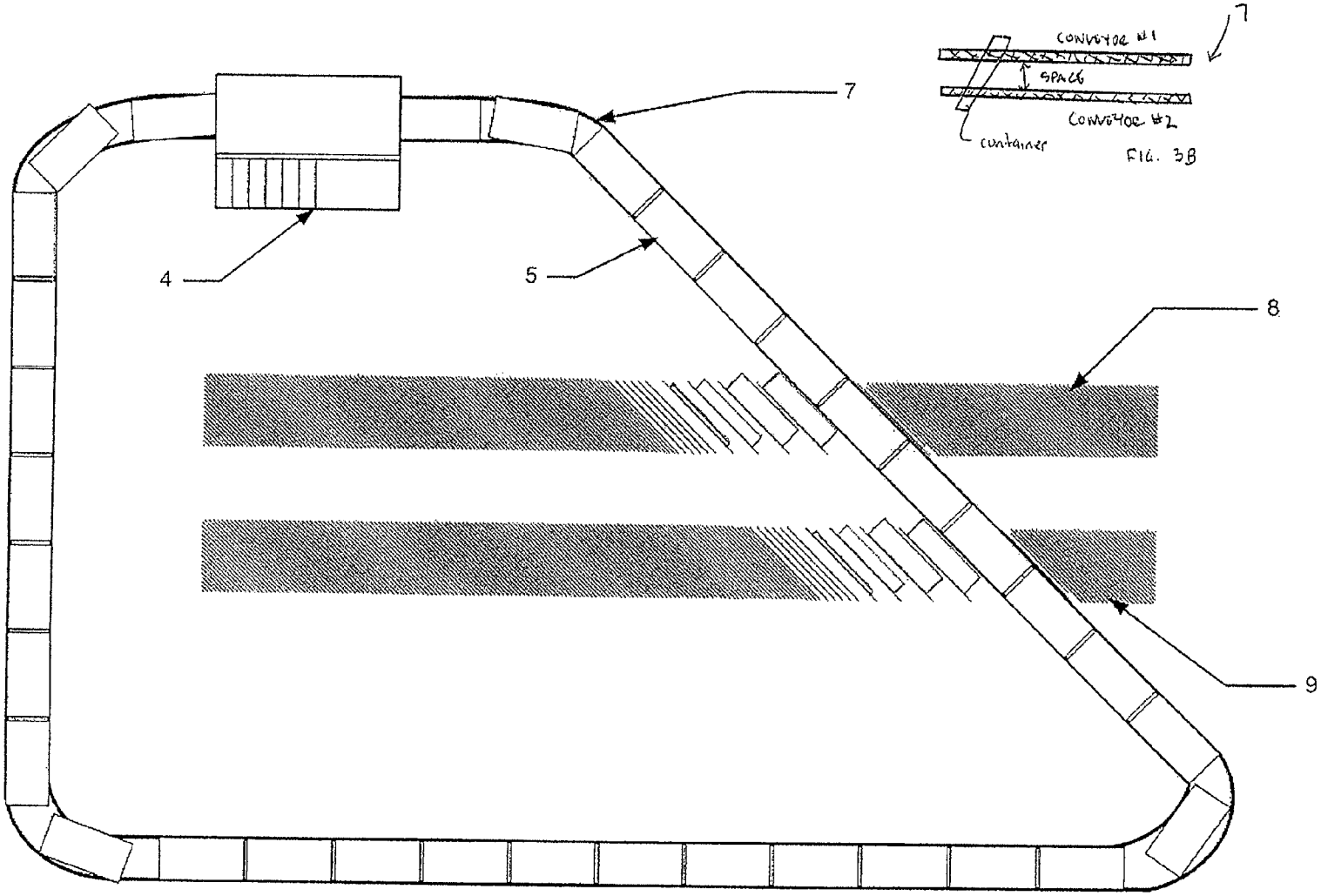
FIGS. 3A-3E are various perspective views of a transport and insertion mechanisms in accordance with aspects of the invention.
Figure 3B:
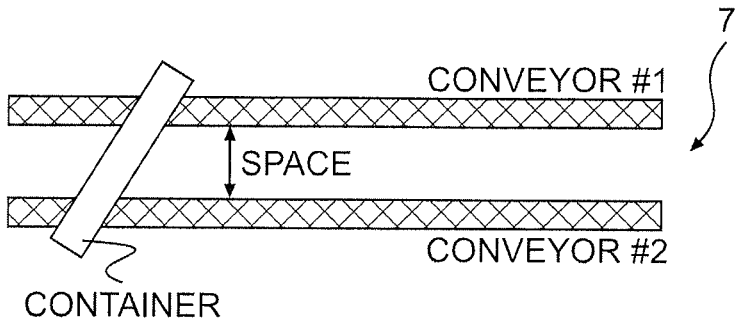
Figure 3C:
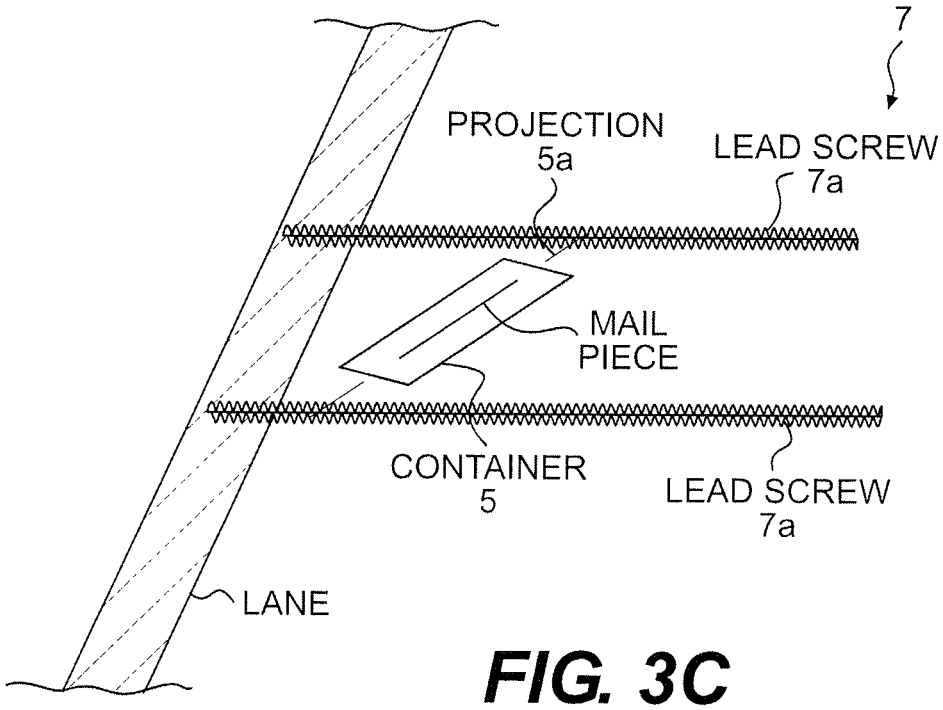
Figure 3D:
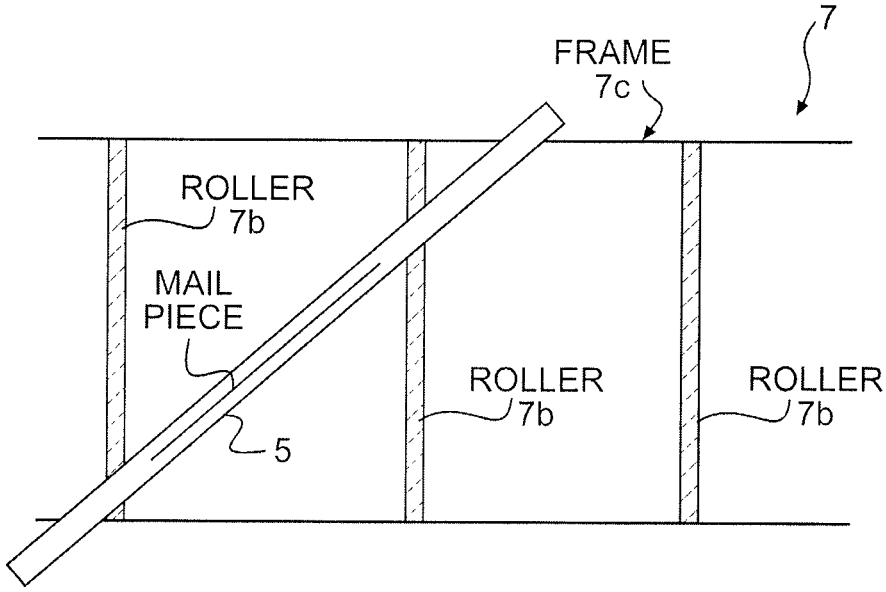
Figure 3E:
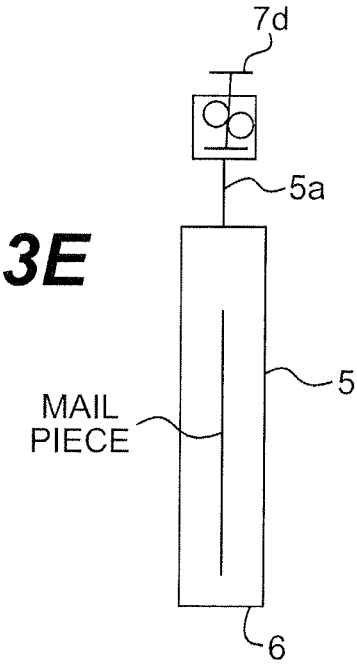
Figure 4:
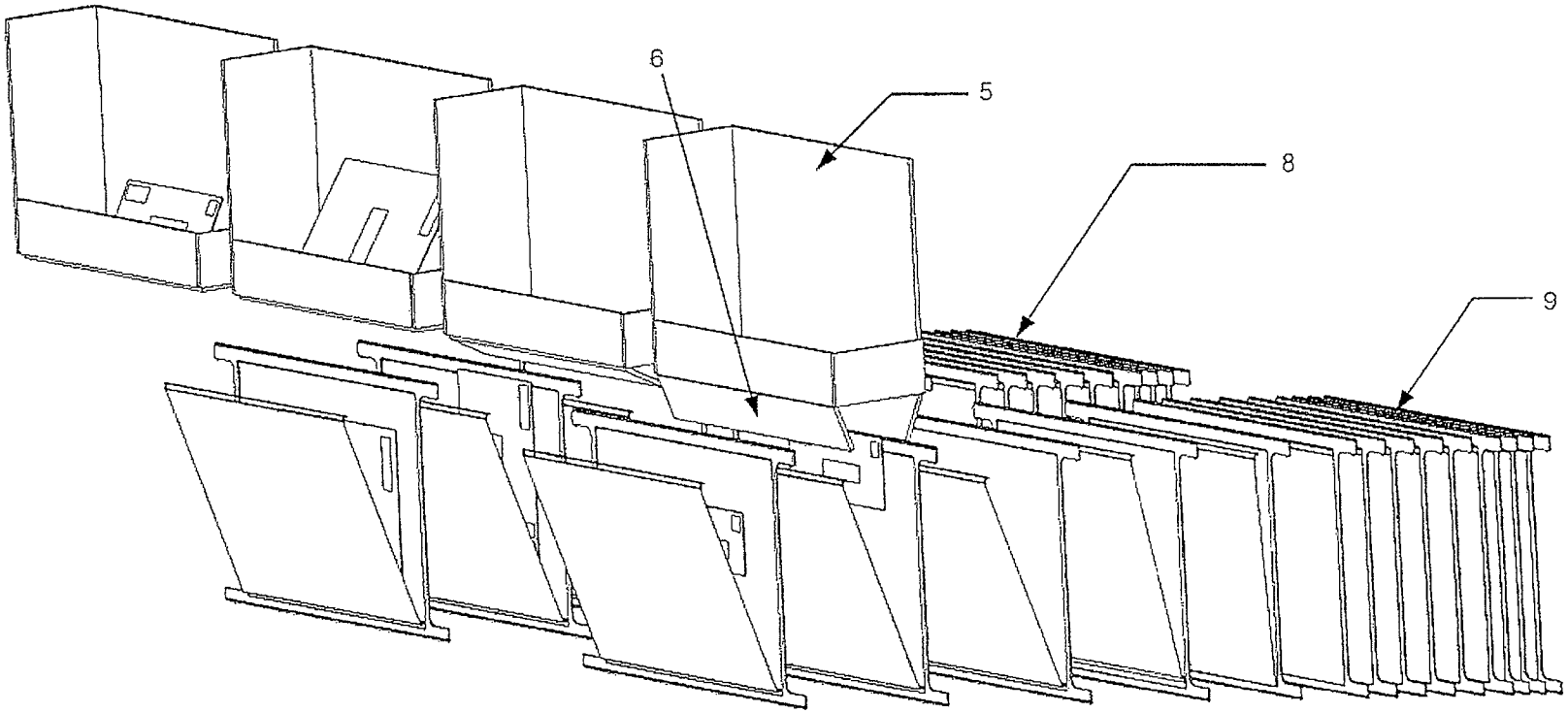
FIG. 4 is an enlarged perspective view of a transport and insertion mechanism using any of the embodiments shown in, e.g., FIGS. 3A-3E, according to aspects of the invention.

FIGS. 2-4 show a semi-automatic insertion mechanism and processes. More specifically, FIG. 2 is a perspective view of containers used to insert mail pieces into folders in accordance aspects of the invention. FIGS. 3A-3E are various perspective views of a transport and insertion mechanisms. FIG. 4 is a perspective view of a transport and insertion mechanism using any of the embodiments shown in, e.g., FIGS. 3A-3E, according to aspects of the invention.

More specifically, FIG. 2 shows several carriers 5 designed and configured to place and transport mail pieces therein. In the illustrative example of FIG. 2, one carrier 5 includes a mail piece that was manually inserted therein by an operator 3. The remaining carriers 5 are empty. In this embodiment, the operator will insert the mail piece, obtained from a stack of mail pieces, at an insertion station (not shown). As noted above, the processes for identifying and processing the mail pieces were performed on the mail pieces prior to the insertion thereof.

In the embodiment of FIG. 2, the carriers 5 have a collapsible bottom 6, which may be, for example, hinge mounted to side walls of the carriers 5 (see, e.g., FIG. 4). More specifically, the bottom 6 is configured to open at certain times and locations, as discussed in more detail with reference to FIG. 4. In one contemplated embodiment, the bottom 6 can be opened by use of servo motors, being coordinated with a drop point.

In further embodiments, the carriers 5 can include open bottoms. In this configuration, the mail pieces rest on a conveyer or other portion of the transport system. This will ensure that the mail pieces remain within the individual carriers 5. At certain drop points, the transport can include sliding or hinge mounted doors such that as the carriers 5 pass a certain drop point, the door will open and the mail piece will drop from the container into an open folder. In yet other embodiments, the bottom 6 can be spring loaded such that when the carriers 5 pass a certain location, the bottom 6 can be automatically opened and thereafter closed.

FIG. 3A shows a transport system configured to transport the carriers 5 in a loop. For example, the transport system can be a conveyor carousel 7 that transports the containers over one or more lanes 8, 9 of folders and back to an insertion station 4. In the embodiment shown in FIG. 3A, two lanes 8, 9 of folders are shown. In this embodiment, lane 8 contains heavy duty folders, while lane 9 contains light duty folders 9. The heavy and light weight folders can be used for different types of mail pieces. For example, the heavy weight folders may be used for larger types of mail pieces; whereas, the light weight folders may be used for postcards, envelopes or other lighter type mail pieces. It should be understood by those of skill in the art that more or less than two lanes of any types of folders are contemplated by the present invention.

In embodiments, a portion of the transport system 7 is provided at an angle corresponding to the position of the folders. In the embodiment shown, the portion is at an angle of approximately 45 degrees. Of course other angles are also contemplated by the present invention including, for example, a 90 degree angle. Also, it should be understood that the transfer lanes 8, 9 can be positioned differently, so long as the folders therein are aligned with the transport system in such a manner that mail pieces can be dropped into the folder from the carriers 5.

In embodiments, the transport system 7 can take many different forms, depending on the type of folders used by the present invention. For example, as shown in FIG. 3B, the transport system can be two conveyors separated by a space. The carriers 5 would be transported on the two conveyors, with a portion of the bottom of the conveyor spanning between the space. The carriers 5 would be configured in such a manner that the bottom 6 can open between the space and drop the mail into an open folder.

In FIG. 3C, the transport system 7 can take the form of lead screws 7*a*. In this implementation, the carriers 5 would include projections 5*a* that mate with the lead screws 7*a*. In this configuration, the carriers 5 would hang downwards from the lead screws. As the lead screws rotate, the carriers 5 are transported towards and thereafter away from the lanes. When a carrier 5 is aligned with a lane and more particular with an open folder in the lane, the bottom 6 of the carrier 5 can be opened in order to drop the mail piece into an open folder.

In yet another embodiment as shown in FIG. 3D, the transport system 7 can include a plurality of rollers 7*b* attached to opposing frame members 7*c*. In this embodiment, the rollers 7*b* can be driven rollers and spaced apart in such a manner as to allow the mail piece within the carriers 5 to drop into an open folder at the required location. In an alternative variation, the rollers 7*b* can be replaced with ties which are also spaced apart in such a manner to allow mail pieces to drop from the carriers 5 into an open folder at the required location. In this alternative variation, the carriers 5 can include wheels that are self propelled by a motor and which ride on the frame members 7*c*.

In still another embodiment, the transport system 7 can include an I beam 7*d* as shown in FIG. 3E. In this embodiment, the carrier 5 includes a frame member 5*a* which is configured to hang from the I beam 7*d*. The frame member 5*a* can include wheels which engage a portion of the I beam 7*d*. When the carrier 5 is aligned with a lane and more particular with an open folder in the lane, the bottom 6 of the carrier 5 can be opened in order to drop the mail piece into an open folder.

In another embodiment, the transport system 7 can include a belt drive system. In this embodiment, which can be represented by FIG. 3A, the transport system 7 would include a door, rod or other blockage point positioned over the transfer lanes. In this embodiment, the belt drive system would act as a bottom of the carrier. As the carrier 5 is moved over the transfer lane and more particularly over a particular open folder, the door, rod or other blockage point would be removed, e.g., slid open, such that the mail within the carrier 5 can be dropped into the open folder.

In FIG. 4, a carrier 5 is aligned with an open folder and a mail piece is being inserted therein. As the carrier 5 passes the open folder, the bottom 6 of the carrier 5 can be opened and the mail piece dropped therein. As an alternative, the conveyor can include a door, rod, etc. which can be opened, e.g., in order to cause the mail piece to drop into the folder. FIG. 4 also shows several folders which already have mail pieces contained therein. In this embodiment, the carriers make use of a trap door bottom 6 which will allow the mail pieces to fall out at the desired time. The carriers 5 then loop around the conveyor carousel 7, back to the insertion station 4.

Figure 5:
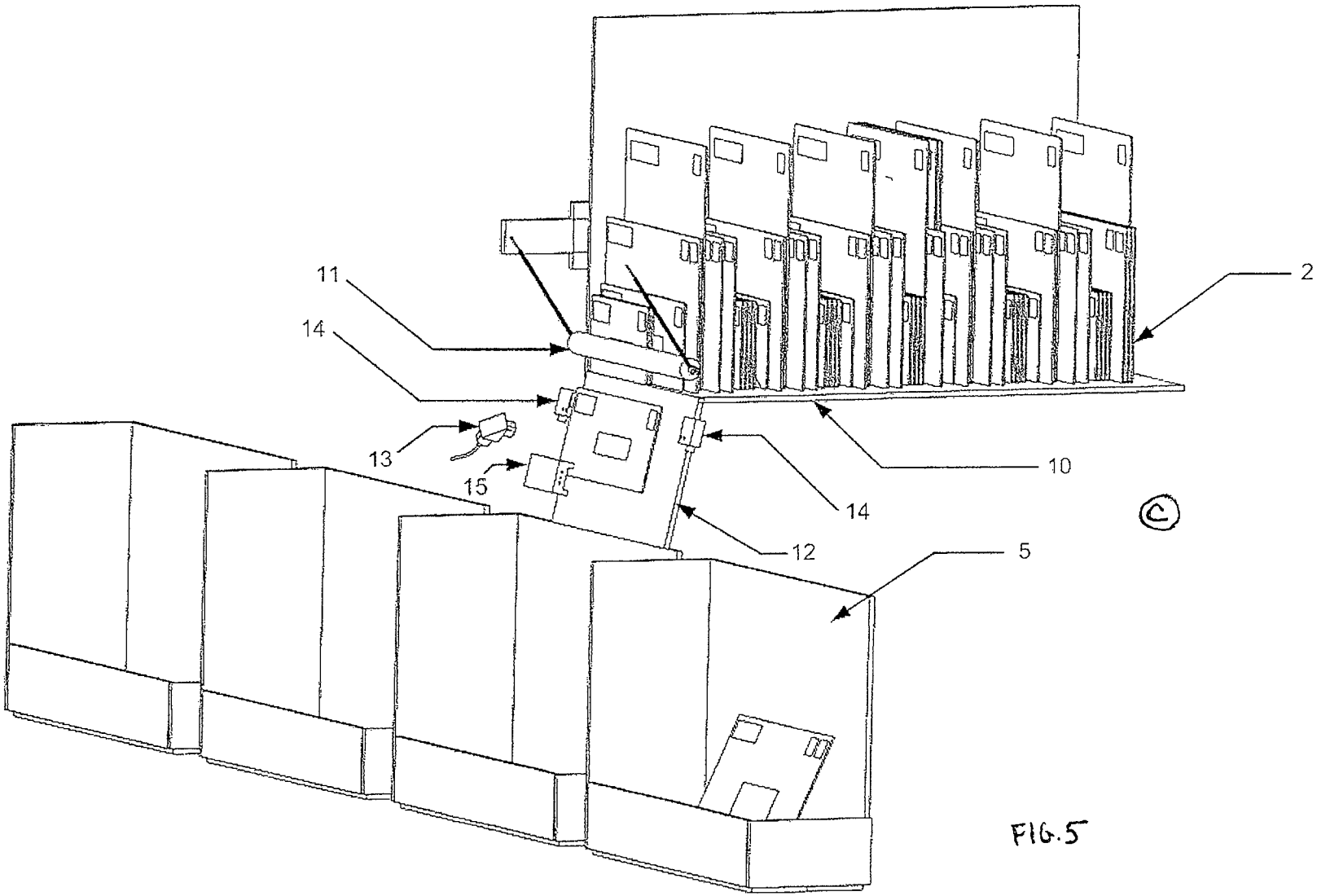
FIG. 5 is a perspective view of a mechanism to insert mail pieces into a container in accordance with aspects of the invention.
Figure 6:
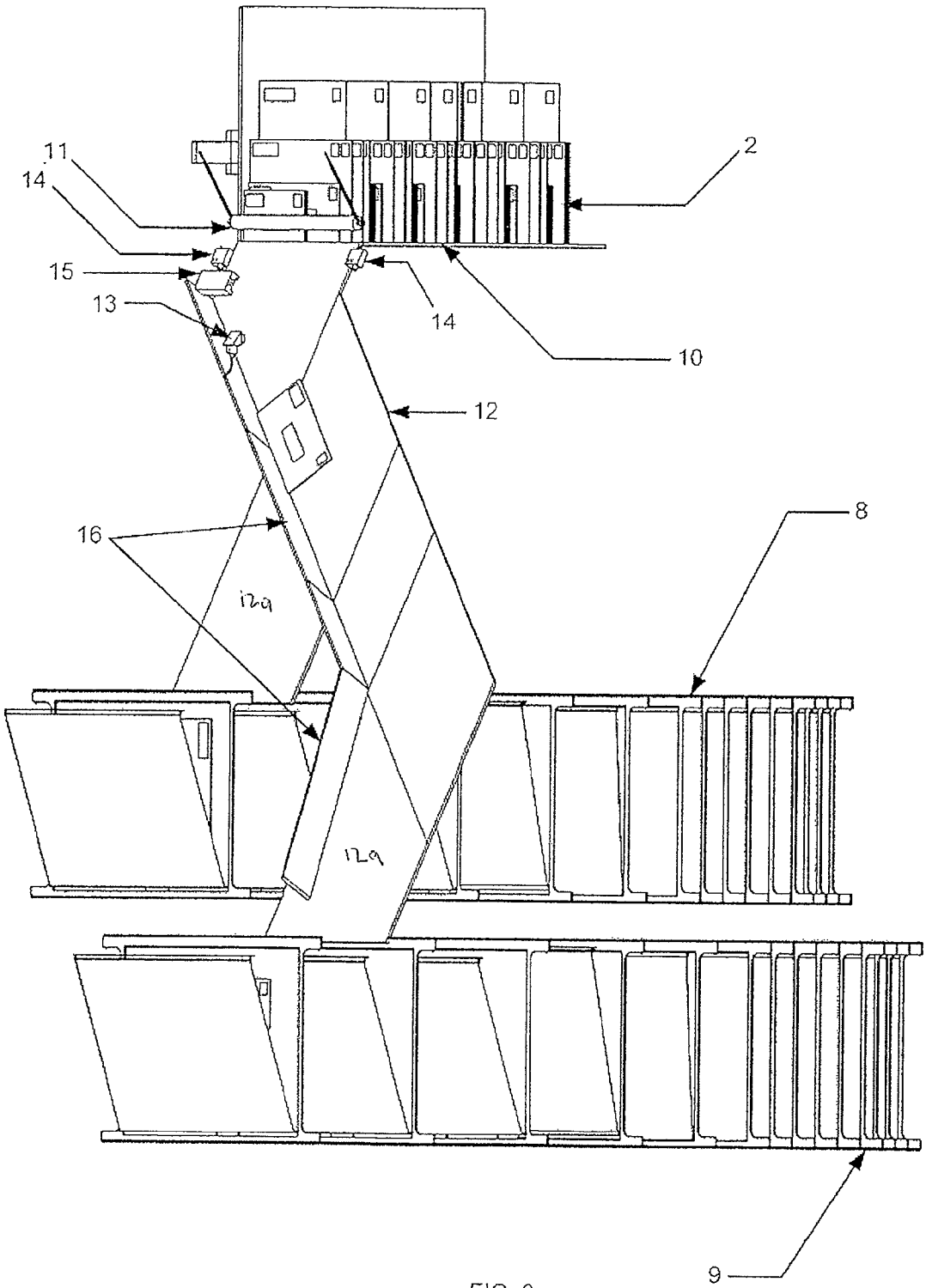
FIG. 6 is a perspective view of a mechanism to insert mail pieces into a container in accordance with aspects of the invention.

FIG. 5 and FIG. 6 show automatic feed systems configured to feed mail pieces into the carriers in accordance with aspects of the invention. In FIG. 5, a stack of mail pieces are placed on a ledge or shelf 10, in a known order. A roller or bar mechanism 11 is placed at the end of the ledge 10 and is designed and configured to allow a single mail piece to pass thereby and slide into an aligned carrier 5 by use of a slide 12. This creates a gravity based feeding of mail pieces into the carriers 5.

The roller or bar mechanism 11 can be manually operated in order to release a single mail piece onto the slide 12. In an alternative embodiment, the roller or bar mechanism 11 can be a vacuum roller which can automatically feed a single mail piece onto the slide 12 and into a respective carrier 5. In the automated embodiment, the vacuum can, for example, provide a suction mechanism to hold a single mail piece and, upon release of the suction, drop the single mail piece onto the slide 12. In yet another embodiment, the roller or bar mechanism 11 can be retracted using, for example, a servo motor. In the retracted position, a single mail piece can be allowed to fall onto the slide 12 and into a respective carrier 5. In any of the embodiments, the roller or bar mechanism 11 can be spring loaded such that it will automatically return to its original position and, in embodiments, provide a force against the stack of mail pieces to ensure that the mail pieces do not accidentally fall onto the slide 12.

Once the roller or bar mechanism 11 releases a mail piece, the mail piece will move down the slide 12 where a plurality of instruments 13, 14 and 15 will determine certain attributes. For example, a camera (or OCR) 13 can take an image of the mail piece, determining the address and reading the bar code. Photo eyes 14 can profile the mail piece such as determining length, and a labeler 15 can tag the mail piece. With this information, the carriers 5 move along the conveyor and drop the mail piece in the appropriate folder.

For example, the above noted information can be provided to a controller "C" which is configured to control and coordinate the movement of the carriers 5 so that they can be aligned with the slide 12. The controller "C", in the automated embodiments, can also control the roller or bar mechanism 11 in order to release the mail pieces. The coordination and movement of the components, e.g., carriers and roller or bar mechanism 11, can be done using logic. The controller "C" can also be used to move the carriers 5 on the transport system and release the mail pieces into separate folders, as well as to identify the carriers with the related mail pieces therein.

In another embodiment shown in FIG. 6, the slide 12 is extended to the folders over both lanes 8, 9. This eliminates the need for the carriers and the transport system. In this embodiment, the elongated slide 12 features trap doors 16, which allow the mail pieces to fall from an extending portion 12*a* of the slide 12 into either the heavy duty folder or the light duty folder, or any other combination of folders contemplated by the invention. The trap doors 16, in the closed position, will also act as a guide for the mail pieces, preventing the mail pieces from falling from the slide 12 as they are being transported to a folder.

Like the embodiment shown in FIG. 5, the mail pieces will move down the slide 12 where a plurality of instruments 13, 14 and 15 will determine certain attributes. For example, a camera 13 can take an image of the mail piece, determining the address and reading the bar code. Photo eyes 14 can profile the mail piece, and a labeler 15 can tag the mail piece. With this information, the mail pieces can drop into an appropriate folder under control of the controller "C".

In embodiments, the instruments can include optical character recognition device (OCR), bar code scanner or the like. The instruments communicate with the controller "C" via an Ethernet, Local Area Network, Wide Area Network, Intranet, Internet or the like. In one particular application, for illustration, the OCR will capture information such as, for example, address destination information, from the mail pieces. Once the information is captured, it will be sent to the central processing unit (e.g., controller) for interpretation and analysis, e.g., to determine sorting and sequencing patterns of the mail pieces. Using this information, the controller "C" can provide instructions to any of the components of the invention for sorting or sequencing of the mail pieces.

The processes and control functions of the components of the invention may be implemented on computer program code in combination with the appropriate hardware. This computer program code may be stored on storage media such as a diskette, hard disk, CD-ROM, DVD-ROM or tape, as well as a memory storage device or collection of memory storage devices such as read-only memory (ROM) or random access memory (RAM). Additionally, the computer program code can be transferred to a workstation or the sort computer over the Internet or some other type of network.

In embodiments, the invention also can include eight different steps of (1) manually placing or directing the mail piece in front of a camera to capture an image of the address for automatic and manual (video coding) address recognition (this step may also include reading the bar code), (2) moving (or placing) the letter into a station that measures the length and width of the mail piece (this can be accomplished through interpretation of the image from step (1), (3) moving (or placing the letter into a station that measure the thickness (profiling the letter size), (4) directing the mail piece (either through manual insertion, a slide or chute, or through moving bins (containers)) to the appropriate size frame, (5) manually or automatically opening the frame, (6) inserting the mail piece into the frame, (7) placing a unique ID on the mail piece (this can be done at anytime during the mail processing, and (8) relating the mail piece characteristics to the unique ID of the mail piece and to the unique ID on the frame.

While the invention has been described in terms of embodiments, those skilled in the art will recognize that the invention can be practiced with modification within the spirit and scope of the appended claims.

It is claimed:

1. A method of inserting mail pieces into individual folders comprising:

automatically opening each of the individual folders;

moving a mechanism, which carries the mail pieces, into alignment with the opened individual folders and inserting an individual mail piece of the mail pieces into respective ones of the opened and spaced apart individual folders; and a roller or bar mechanism placed at an end of a ledge positioned adjacent the mail pieces and which is retractable to provide a force against the mail pieces to (i) ensure that the mail pieces do not accidentally fall onto a slide and (ii) allow a single mail piece to pass thereby and slide into an aligned carrier or a folder positioned below the ledge, by the slide.

2. The method of claim 1, further comprising placing the mail piece in a carrier.

3. The method of claim 2, wherein the aligning includes placing the carrier over the opened folders.

4. The method of claim 3, further comprising opening a bottom of the carrier when the carrier is over the opened individual folders to insert the mail pieces into the opened folders.

5. The method of claim 3, further comprising opening a door or other blocking mechanism on a transport system to insert the mail pieces in the opened individual folders.

6. The method of claim 1, wherein the aligning includes aligning the folders under a sliding mechanism.

7. The method of claim 6, further comprising opening a door on the sliding mechanism in order to insert the mail piece into the opened folders.

8. The method of claim 1, wherein the opening of the folder comprising contacting a tab or appendage, extending from the folder, on a stationary object.

9. The method of claim 1, wherein the opening of the folder comprises contacting the folder on a floor or other stationary object resulting in the folder being pushed upward and expanding into a box.

10. The method of claim 1, wherein the mechanism is a carrier which has a collapsible bottom that opens between two conveyors when the carrier is aligned with the respective ones of the opened folders such that the mail pieces fall therein.

11. The method of claim 1, wherein the roller or bar mechanism is spring loaded to automatically return to its original position and provide a force against the mail pieces to ensure that the mail pieces do not fall onto the slide.

* * * * *